US005765228A

United States Patent [19]

Bieling

[11] Patent Number: 5,765,228

[45] Date of Patent: Jun. 16, 1998

[54] CONTINUOUS PASSIVE MOTION THERAPY MITT

[75] Inventor: Ross Bieling, Pinellas Park, Fla.

[73] Assignee: Select Medical Products, Inc., Pinellas Park, Fla.

[21] Appl. No.: 177,159

[22] Filed: Jan. 4, 1994

[51] Int. Cl.[6] ..... A41D 19/01

[52] U.S. Cl. ..... 2/158; 2/159; 2/163; 128/879

[58] Field of Search ..... 2/158, 159, 161.6, 2/161.7, 163, 169; 128/879, 878, 877; 602/21

[56] References Cited

U.S. PATENT DOCUMENTS

| | | | |
|---|---|---|---|
| 170,957 | 12/1875 | Kinsley | 2/159 |
| 1,714,648 | 5/1929 | Walker | 2/158 |
| 2,327,381 | 8/1943 | Wells | 2/158 |
| 3,774,242 | 11/1973 | Owen | 2/158 |
| 4,365,352 | 12/1982 | Zidele | 2/169 |
| 4,796,306 | 1/1989 | Mitchell | 2/163 |
| 5,127,127 | 7/1992 | Jarosinski | 2/159 |

FOREIGN PATENT DOCUMENTS

| | | | |
|---|---|---|---|
| 165791 | 4/1950 | Austria | 2/158 |

OTHER PUBLICATIONS

Brochure—Nov. 1992 by Danninger Medical Technology, Inc. pp. 2 & 3.

Advertisment—Wrist/Toe CPM by Danninger.

*Primary Examiner*—Amy B. Vanatta

*Attorney, Agent, or Firm*—David W. Pettis, Jr., P.A.

[57] ABSTRACT

A therapy mitt for a hand and finger for use with a hand therapy device comprising a surface disposed along the back of the hand connecting finger pockets to a wrist cuff of the hand therapy device. The finger pockets are capable of being separated from one another, permitting independent motion of fingers relative to one another. This therapy mitt can thus be used either for all four fingers or for independent therapy of individual fingers.

7 Claims, 6 Drawing Sheets

CONTINUOUS PASSIVE MOTION THERAPY MITT

BACKGROUND OF THE INVENTION

1. Field of the Invention

The present invention relates to a glove or mitt for continuous motion hand therapy devices. The glove or mitt is used to hold the hand in position within the hand therapy device during therapy At present fingers are held in hand therapy devices in one of two ways:

The first way is through a mitt which is attached to the hand therapy device. By use of this mitt the hand therapy device can flex the patient's fingers by moving through a preset range of motion. Existing mitts do not permit separate motion of the individual fingers, but require that all fingers be moved in tandem, thereby limiting the achievable range of motion of each individual finger. Existing mitts do not include the thumb, which is ordinarily not treated by flexing through a range of positions.

The second method for holding fingers in hand therapy devices is the use of an adhesive tape which is wrapped around the tip of the finger, and attaches to a knob on a limb on the hand therapy device. Movement in the limb produces a corresponding movement in the finger which is attached to the limb by the adhesive tape. Several problems are evident from this description: the tape is subject to be being lost and is insufficiently firm; and the tape does not lend itself to reuse.

The present invention provides all the benefits of existing mitts with the additional ability of separating the finger pockets of the present mitt from each other, permitting independent finger motion. The present invention thereby combines all the benefits of existing mitts and adhesive tape methods, with the added benefits of reusability, general manufacture and interchangeability.

SUMMARY OF THE INVENTION

An elastic material is cut into the shape of a mitt, to which finger pockets are sewn. The finger pockets are joined together but may be separated from each other by simple cutting means. When separated they are still attached to the main body of the therapy mitt and therefore continue capable of attaching a finger in that finger pocket to the limb of the hand therapy device. Therefore, the present invention can function either as a mitt, where all four fingers are flexed simultaneously and in tandem, or as a holder for individual fingers which will be put through independent flexing motions.

The invention accordingly comprises an article of manufacture possessing the features, properties, and relation of elements which will be exemplified in the article of manufacture hereinafter described and the scope of the invention will be indicated in the claims.

BRIEF DESCRIPTION OF THE DRAWINGS

For a full understanding of the nature and object of the invention, reference should be had to the following detailed description taken in connection with the accompanying drawings in which.

DETAILED DESCRIPTION

Figure 1:
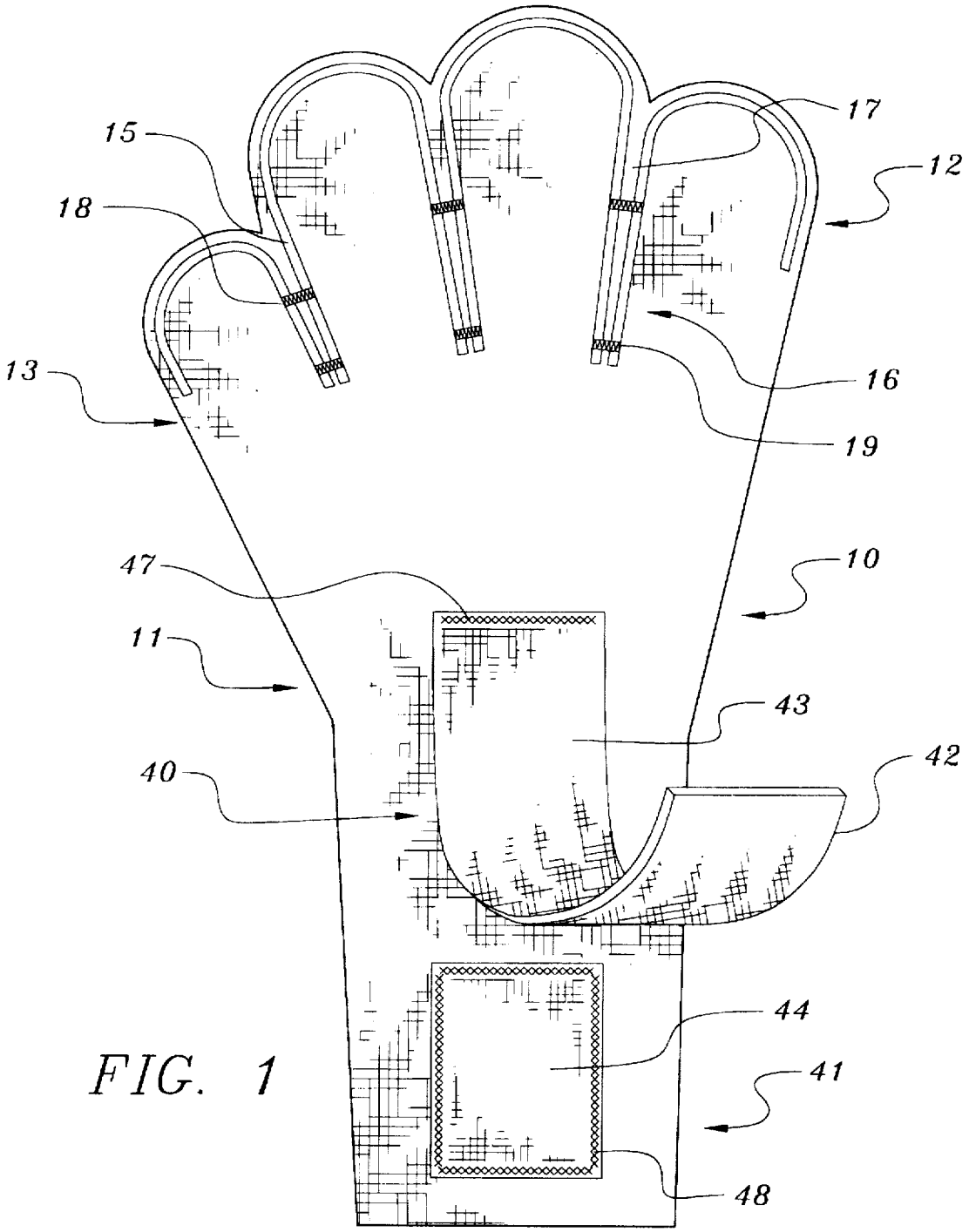
FIG. 1 is a top view of a hand therapy mitt embodying the present invention, not mounted to a hand.
Figure 2:
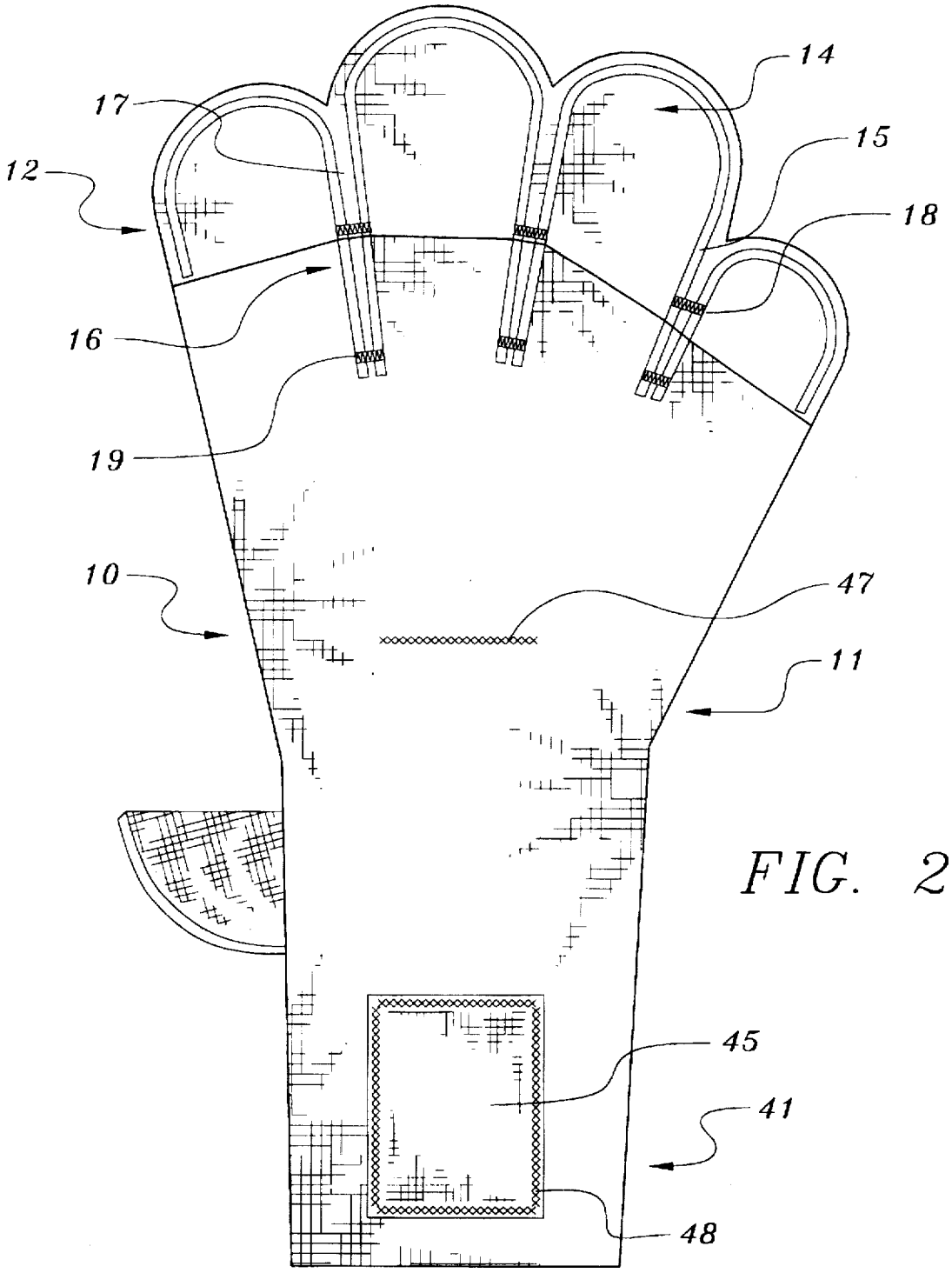
FIG. 2 is a bottom view of a hand therapy mitt according to the present invention, not mounted to a hand.
Figure 5:
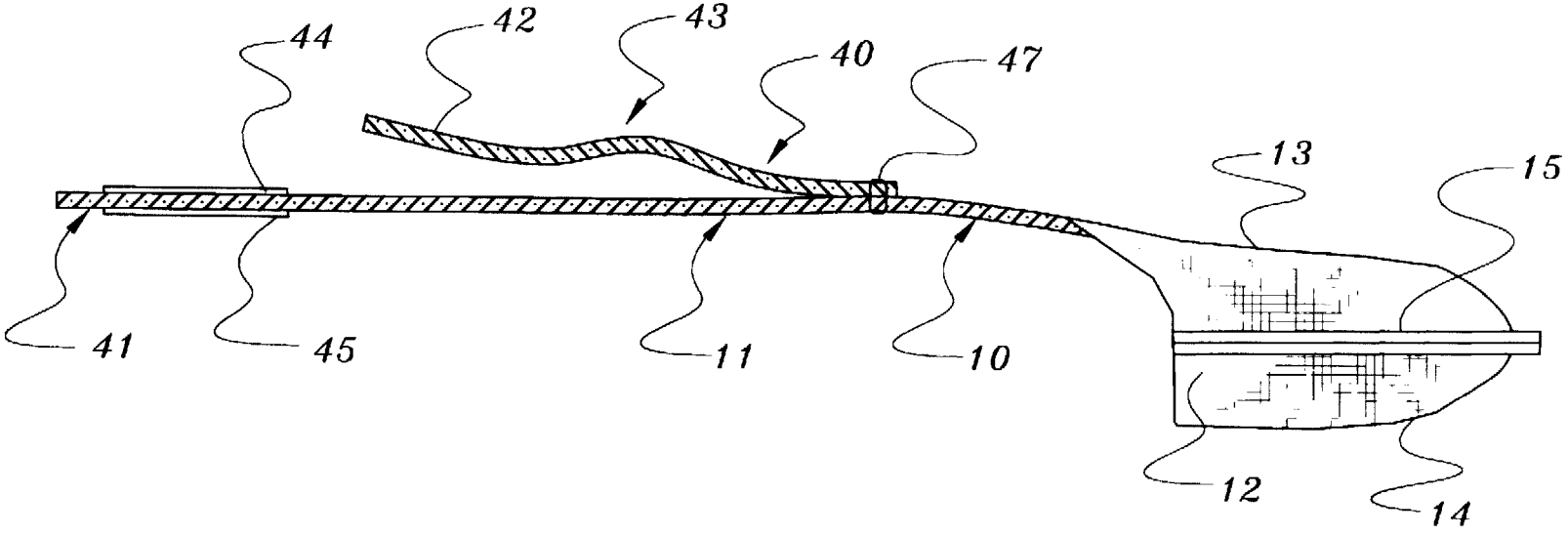
FIG. 5 is a side view of a hand therapy mitt, not mounted to a hand.

FIGS. 1, 2 and 5 depict the present invention when not mounted to a hand, generally indicated as 20. The present invention, a hand therapy mitt, generally indicated as 10 shall be described in three parts.

Central Portion

The central portion of the hand therapy mitt 10, or main surface, generally indicated as 11, is designed to stretch across the back 21 of a hand 20.

Finger Pockets

From the main surface 11 in the direction of the fingers 22 the hand therapy mitt 10 has a first surface, generally indicated as 13. This first surface 13 may be continuous with and the same material as the main surface 11. Both the main surface 11 and the first surface 13 may be made of an elastic material, such as thin neoprene rubber.

Below the first surface 13 lies a second surface, generally indicated as 14. The fingers 22 are trapped between the first surface 13 and the second surface 14 at their tips 23. The second surface 14 extends from the tips 23 of the fingers 22 along the bottom of the fingers 22 to a point between the first joint 24 and the second joint 25 of the fingers, as can be seen from FIG. 3. A finger pocket, generally indicated as 12, is formed between the first surface 13 and the second surface 14 by a pocket stitching line 15 which ties the first surface 13 to the second surface 14 in an arc about the finger 22, as can be seen from FIG. 3.

In the space between two fingers, there is a spaced apart and generally parallel stitching portion, generally indicated as 16, where the stitching lines 15 of two adjacent fingers 22 lie generally parallel to each other. The space between two generally parallel stitching lines is defined for this specification as an interstitial space, generally indicated as 17. Although parallel stitching is one possible embodiment, there is no requirement that the stitching be parallel.

Referring now to FIG. 2, a first anchor stitch 18 connects two parallel lines 15 and the first surface 13 and the second surface 14 near that end of the second surface 13 which is closest to the wrist of the hand 20. The pocket stitching lines 15 between the fingers 22 extend beyond the second surface 14 to an area generally proximal to the third joint 26 of the fingers 22. The third joint 26 defines where the finger 22 meets the hand 20. In this area near the third joint 26 a second anchor stitch connects the pocket stitching lines 15 of two adjacent finger pockets 12.

The pocket stitching lines 15 are separate for each finger 22 to permit cutting of the first surface 13 and the second surface 14 along the interstitial space 17. If this cutting runs up to but not including the first anchor stitch 18, then the two adjacent fingers 22 are permitted movement independent of each other to the first joint 24 and perhaps to the second joint 25. If the cut extends through the first anchor stitch 18 and up to but not including the second anchor stitch 19, then the two adjacent fingers are permitted movement relative to each other that is independent, in the first 24, second 25, and third joint 26.

Figure 6:
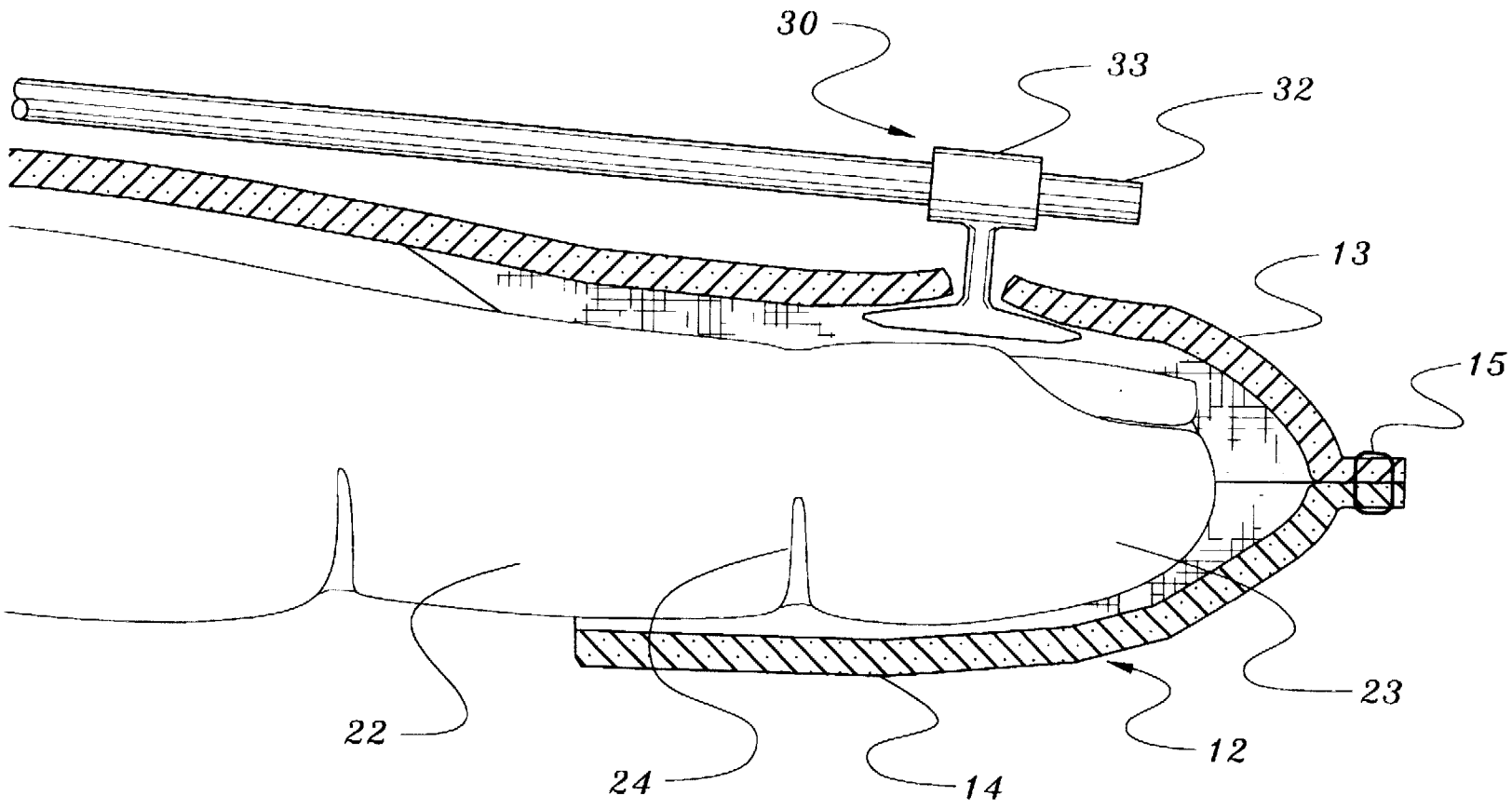
FIG. 6 is a side cross sectional view of a finger pocket portion of a hand therapy mitt according to the present invention, with a finger inserted into the finger pocket, showing how the finger pocket is mounted to the limb of a hand therapy device.

The finger pockets 12 permit attachment of the therapy mitt 10 to the limbs 32 of a hand therapy device, generally indicated as 30. A limb 32 attaches to a finger pocket 12 by use of a knob 33 attached to the limb 32. The knob 33 passes through a hole in the finger pocket 12 and is wider inside the finger pocket 12 than the hole. Details of this will be seen in FIG. 6. By connecting the limb 32 of the hand therapy device 30 to the finger pocket 12, the finger 22 is forced to move in concert with the limb 32.

Wrist Cuff Fastening

Referring now to FIG. 5, the portion of the therapy mitt 10 farthest from the fingers 22 forms means for attachment to the wrist cuff 31 of the hand therapy device 30, generally indicated as 40. In this figure the means for attachment 40 are, a strap 42 having on one side a first releasable fastening surface, generally indicated as 43.

The portion of the therapy mitt 10 farthest from the fingers 22 can also be called a cuff wrapping surface, generally indicated as 41. Disposed upon the cuff wrapping surface 41 is a second releasable fastening surface 44 and disposed under the cuff wrapping surface 41 is a third releasable fastening surface 45. Both the second 44 and the third 45 releasable fastening surfaces are attached to the cuff wrapping surface 41 by fastening stitching 48. The strap 42 is attached to the main surface 11 by strap stitching 47.

Figure 4:
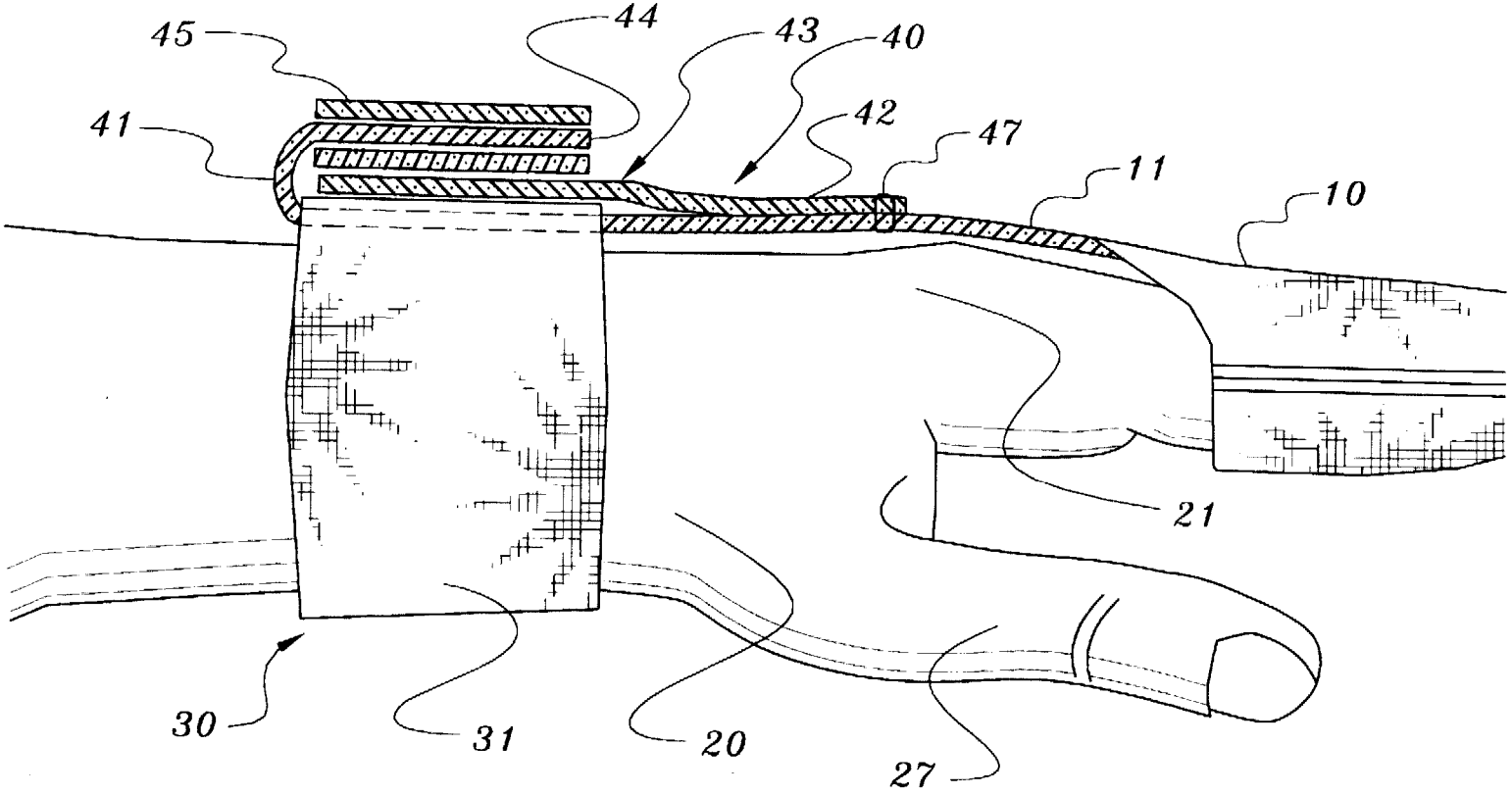
FIG. 4 is a side view of a hand therapy mitt according to the present invention, mounted to a hand, showing attachment to a wrist cuff of a hand therapy device.

Referring now to FIG. 4, in this embodiment, means for attachment 40 involves placing the wrist cuff 31 of the hand therapy device 30 over the cuff wrapping surface 41 and folding the cuff wrapping surface 41 back over the wrist cuff 31. By laying the strap 42 over the outside of the wrist cuff 31, the second releasable fastening surface 44 adjustably engages the first releasable fastening surface 43 and thereby holds the hand therapy mitt 10 in place, held tight to the hand therapy device 30 by the wrist cuff 31.

Stacking Hand Therapy Mitts

When not in use on the hand 20 of a patient, the therapy mitt 10 can be stacked conveniently. When laid flat one upon another, the third releasable fastening surface 45 of the upper therapy mitt 10 engages the second releasable fastening surface 44 of the lower therapy mitt 10 holding the two therapy mitts 10 in a convenient bundle. This works identically for a third, fourth, etc. mitt.

Figure 3:
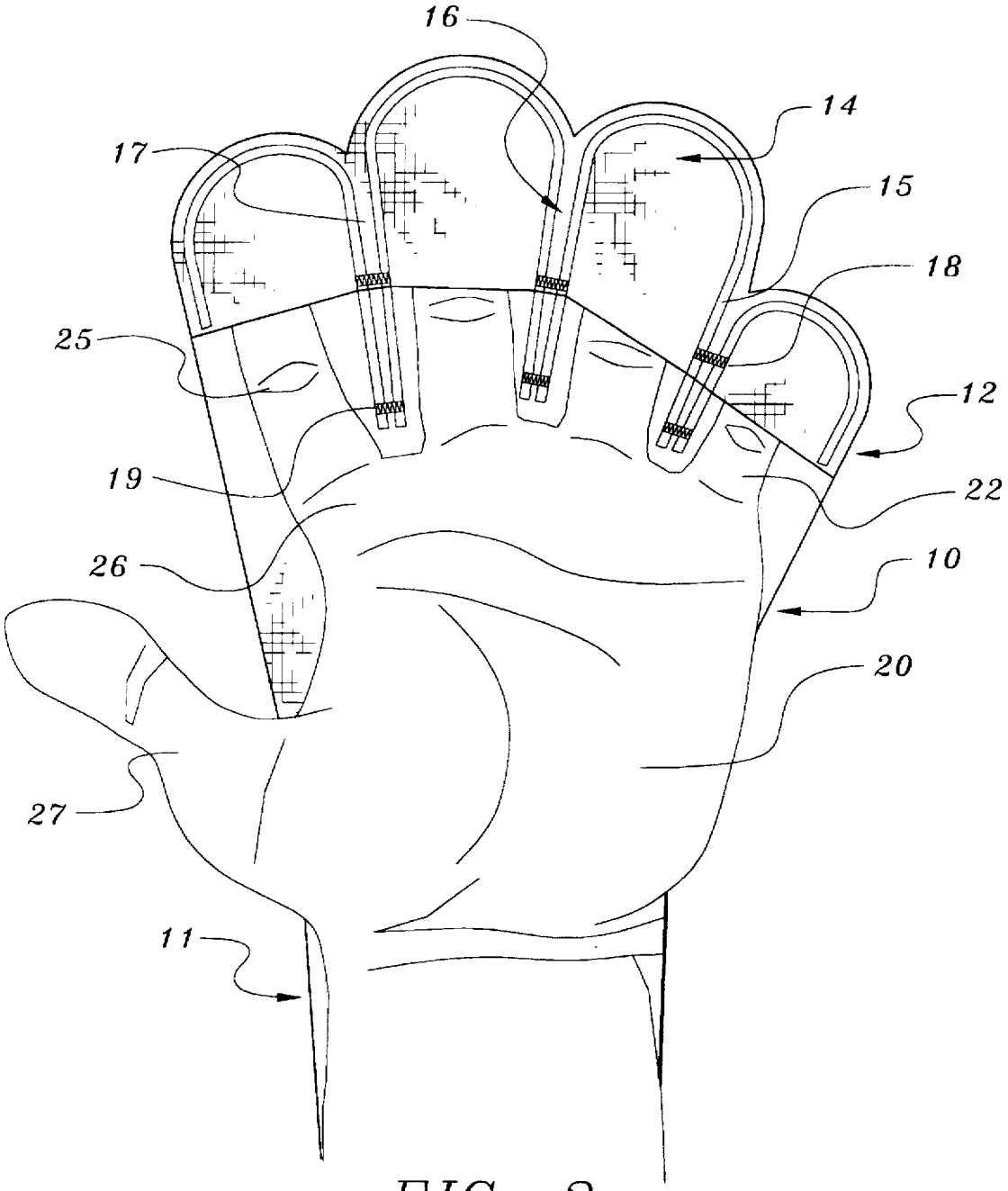
FIG. 3 is a bottom view of a hand therapy mitt according to the present invention, mounted to a hand.

As can be seen from FIGS. 3 and 4, the thumb 27 is not restrained by the present invention.

Non-Exclusive Suggested Equivalent Materials and Construction

The material used for the main surface 11, the first surface 13, the second surface 14, and the cuff wrapping surface 41 may be an elastic material such as thin neoprene rubber. The material used may also be an inelastic cloth material or a plastic material. It is the form of the material which is important to the present invention, rather than its specific nature. However, an elastic and durable material is preferred. Although the cuff wrapping surface 41 is shown as continuous with the main surface 11, this is not necessary to the present invention. The cuff wrapping surface 41, need not be a continuous material with the main surface 11, but can well be a separate piece of material which is attached to the main surface 11 by any of the well known means of attaching two materials to one another. The cuff wrapping surface 41 as described in the previous detailed description need not have the form that is shown in the drawings. Any method of looping from the main surface 11 around the wrist cuff 31 and to the strap 32 is acceptable.

The strap 42 may be made of any material including textiles, elastic materials such as thin neoprene rubber, or plastics. The preferred material of the strap is a durable inelastic textile.

Both the first 18 and the second 19 anchor stitches can be replaced by any means for preventing further ripping of already made cut, such as staples, heat sealing, multiple stitch lines, etc.

Throughout the specification when reference is made to stitching, for example, the pocket stitching lines 15, it is understood that any alternative method of bonding two materials such as the materials listed above together will be suitable for the present invention. Example for such suitable means for bonding include adhesive, heat sealing, rivets, etc.

Although the finger pockets 12 has been described as ending between the first 24 and second joint 25, this is not necessary for the present invention, and the present invention does not require that the finger pocket 12 end before the second joint 25. It is equally effective if the finger pocket 12 ends between the second 25 and third joint 26, or even if the finger pockets 12 extends beyond the third joint 26. The present invention does not require that the finger pocket 12 be a continuous enclosure. It is perfectly acceptable for the present invention that the finger pocket have air holes or vents or strips removed for economy of material, ventilation, or machine specific requirements.

Although the specification describes attachment to a hand therapy device, the description will be seen as illustrative of an equivalent device for the foot and toes.

Although the detailed description above lists a working embodiment, no part of this description should be construed as limiting the invention from embodiments which have additional straps or means for fastening which attach the hand therapy mitt 10 to the patient's hand 20.

Although the present invention has been described as fastening to a wrist cuff 31, alternative hand therapy devices are easily adapted to by the present invention. The above description should not be construed to limit the present invention to a hand therapy device having a wrist cuff, but rather is illustrative of one device to which the present invention is capable of attachment.

It will thus be seen that the object set forth above those made apparent from the preceding description, are efficiently attained, and since certain changes may be made in the above article without departing from the scope of the invention, it is intended that all matter contained in the above description or shown in the accompanying drawings shall be interpreted as illustrative and not in limiting sense.

It is also to be understood that the following claims are intended to cover all of the generic and specific features herein described, and all statements of the scope of the invention which, as a matter of language may be said to fall there between.

Now that the invention has been described:

What is claimed is:

1. A therapy mitt for a hand with a back and fingers for use with a hand therapy device having a wrist cuff and limbs for moving and restraining the fingers, the limbs ending in knobs whereby the limbs may be connected to the fingers at their tips, said therapy mitt comprising:

a main surface covering the back of the hand;

means for attachment to the wrist cuff, said means for attachment being attached to said main surface;

a plurality of finger pockets for insertion of a corresponding plurality of fingers, each one of said pockets being connected to said main surface and extending to a point between a first and second joint along a finger inserted therein opposite said main surface;

said finger pockets being formed of a first and second surface, said first and second surfaces being connected to each other by pocket stitching, said pocket stitching comprising separate stitching lines for each of said finger pockets, said stitching lines being shaped around each of said fingers, said first and second surfaces forming two halves of said finger pockets, said stitching lines joining said two halves into said finger pockets;

said first surface continuing without interruption between said finger pockets, and said first surface being connected to said main surface;

said second surface continuing without interruption between said finger pockets, such that said finger pockets are formed of two continuous surfaces, said finger pockets being defined by said stitching lines, said fingers being forced to flex in concert with each other when operationally connected to the hand therapy device;

said stitching lines being spaced apart from each other in the space between adjacent ones of said finger pockets, said space being in a generally parallel stitching portion defining an interstitial space between said finger pockets and between said stitching lines; and a first and second anchor stitch connecting adjacent ones of said separate stitching lines across said interstitial space, said first anchor stitch lying generally between the first and second joints of adjacent fingers, said second anchor stitch lying generally where said adjacent fingers meet the hand, such that said first and second surfaces can be cut along said interstitial space as far as said first anchor stitch, freeing said fingers adjacent to said interstitial space to flex independently of each other at their first and second joints, and such that said first and second surface can be cut along said interstitial space as far as said second anchor stitch, freeing said fingers adjacent to said interstitial space to flex independently of each other in all three joints, and such that said knobs attach to said finger pockets on said first surface when operationally connected to the hand therapy device.

2. The therapy mitt of claim 1 wherein said first, second, and main surfaces are made of an elastic material.

3. The therapy mitt of claim 2 wherein said elastic material is neoprene rubber.

4. The therapy mitt of claim 3 wherein said elastic material is thin neoprene rubber.

5. The therapy mitt of claim 4 wherein said first surface and said main surface are one continuous piece of said material.

6. The therapy mitt of claim 5 wherein said means for attachment further comprises:

a cuff wrapping surface connected to said main surface and disposed around said cuff, said cuff wrapping surface having a first releasable fastening surface disposed upon it; and a strap extending from and attached to said main surface, said strap having a second releasable fastening surface, said second releasable fastening surface adjustably engaging said first releasable fastening surface, such that said therapy mitt is firmly attached to said hand therapy device and said fingers do not slide out of said pockets.

7. The therapy mitt of claim 6 wherein there are four fingers, said four fingers excluding the thumb.

* * * * *